US005529331A

United States Patent [19]

Hoelzl et al.

[11] Patent Number: 5,529,331

[45] Date of Patent: Jun. 25, 1996

[54] SAFETY SKI BINDING

[75] Inventors: Klaus Hoelzl; Reinhold Wawra; Alois Himmetsberger, all of Vienna; Hubert Wuerthner, Hainburg/Donau; Karl Stritzl, Vienna; Andreas Janisch, Oeynhausen; Helmut Wladar, Vienna, all of Austria

[73] Assignee: HTM Sport- und Friezeitgeraete Aktiengesellschaft, Schwechat, Austria

[21] Appl. No.: 325,189

[22] PCT Filed: Dec. 17, 1993

[86] PCT No.: PCT/EP93/03591

§ 371 Date: Oct. 14, 1994

§ 102(e) Date: Oct. 14, 1994

[87] PCT Pub. No.: WO94/17872

PCT Pub. Date: Aug. 18, 1994

[30] Foreign Application Priority Data

Feb. 15, 1993 [AT] Austria ..... 274/93

[51] Int. Cl.[6] ..... A63K 9/08

[52] U.S. Cl. ..... 280/634; 280/625; 280/626; 280/632

[58] Field of Search ..... 280/625, 626, 280/627, 628, 629, 631, 632, 633, 634

[56] References Cited

U.S. PATENT DOCUMENTS

| | | | |
|---|---|---|---|
| 3,647,233 | 3/1972 | Martin | 280/632 |
| 4,365,822 | 12/1982 | Nitschko et al. | 280/625 |
| 4,593,929 | 6/1986 | Scheck et al. | 280/625 |
| 4,784,404 | 11/1988 | Kowatsch | 280/634 |
| 4,974,869 | 12/1990 | Muhlberger et al. | 280/634 |
| 5,044,658 | 9/1991 | Challande et al. | 280/631 |
| 5,056,810 | 10/1991 | Rigal | 280/625 |
| 5,149,124 | 9/1992 | Wittmann et al. | 280/634 |
| 5,205,575 | 4/1993 | Wladar | 280/634 |

FOREIGN PATENT DOCUMENTS

| | | | |
|---|---|---|---|
| 361823 | 8/1980 | Austria . | |
| 0547531 | 6/1993 | European Pat. Off. | 280/629 |
| 3201319 | 7/1983 | Germany | 280/633 |

*Primary Examiner*—Margaret A. Focarino
*Assistant Examiner*—Min Yu
*Attorney, Agent, or Firm*—Flynn, Thiel, Boutell & Tanis

[57] ABSTRACT

A front jaw for a safety binding comprising a lower part (3) of a housing, which lower part can be fastened to a ski, and an upper part (2) of a housing having at least one adjustable release spring (4) and two pivotal sole holders (14*a*, 14*b*) biassed by this release spring, with the upper part (2) of the housing being pivotal in the position of use of the front jaw about a transverse axis (Q) extending essentially normally with respect to the central longitudinal axis (L) of the front jaw, and the swivelling capability of the upper part of the housing relative to the lower part of the housing being limited by a locking piece (15, 115) having at least one stop surface (32$a_1$, 32$b_1$, 32$a_2$, 32$b_2$, 32$a_3$, 32$b_3$, 32$a_4$, 32$b_4$), which locking piece is supported horizontally movably in the lower part (3) or the upper part (2) of the housing, with this locking piece (15, 115), in the position of use of the ski binding, cooperating with a stop (29*a*, 29*b*) provided on the upper part or lower part of the housing, so that the swivelling movement of the upper part of the housing relative to the lower part of the housing is limited in this position.

14 Claims, 5 Drawing Sheets

SAFETY SKI BINDING

FIELD OF THE INVENTION

The invention relates to a front jaw for a safety binding comprising a lower part of a housing adapted to be fastened to a ski and an upper part of a housing having at least one adjustable release spring and two pivotal sole holders biassed by the release spring, with the upper part of the housing being pivotal in the position of use about a transverse axis which extends essentially normally with respect to the central longitudinal axis of the front jaw, and the swivelling capability of the upper part of the housing relative to the lower part of the housing being defined by a locking means.

BACKGROUND OF THE INVENTION

A front jaw, in which an adjustment of the elevational position of the sole holders to the height of the sole of the shoe is possible by swivelling the upper part of the housing relative to the lower part of the housing, is disclosed in DE-OS 39 37 363. The upper part of the housing is in this conventional front jaw designed in one piece with the lower part of the housing, with a flexible area being provided in the front area of the jaw, which flexible area makes possible a limited swivelling of the upper part of the front jaw to adjust the position of the sole down-holding means to the height of the sole. This flexible area is produced by a horizontal slot, which is constructed in the front part of the jaw between the release spring and the upper surface of the ski. The locking means is realized on the one hand by a rearwardly projecting nose constructed in one piece with the upper part of the housing, and on the other hand by a spring-loaded rocking lever supported in the lower part of the housing, or a forwardly projecting nose constructed in one piece with the lower part of the housing.

Such a device has a number of disadvantages. The strength of the housing of the ski binding is weakened with the above-identified slot, thus material fatigue can easily occur followed by a breakage of the housing. Furthermore, the swivelling capability of the housing is blocked when this slot gets dirty or ices up, with the danger of breakage being additionally increased by an overload on the sole down-holding means. The front jaw has furthermore a complex design because of the locking means, which is formed thereon in one piece, and is therefore expensive to manufacture.

A front jaw consisting of two housing parts, which is assembled around a transverse axis by swivelling one housing part relative to the other, has become known from DE-OS 39 42 157. The two housing parts are then in the position of use screwed together by means of a vertically arranged screw, with the elevational adjustment of the sole holders being carried out at the same time by means of this screw. This screw and the counterthread provided in the lower part of the housing thus form the locking means for this conventional front jaw. A disadvantage of this device is that the sole holders, when using different ski shoes, must be newly adjusted for each shoe by a serviceman. Moreover, a structurally favorable arrangement of the release spring is prevented by the screw, which, viewed from above, is centrally arranged.

A further device, which enables a change of the elevational position of the sole down-holding means of a front jaw, is described in AT-PS 361 823. A down-holding arm loaded by a spring is in this device pivotally arranged above the release spring on a transverse axis. Elevationally adjustable sole down-holding means are mounted on the down-holding arm. The elevational change of the sole down-holding means created by pivoting the down-holding arm, however, is used in this device to free the ski shoe in upward direction in the case of a release, and not to adjust the ski binding to different soles of shoes, which continues to be done by means of adjusting screws. This device is thus not suited for an automatic adjustment of the sole down-holding means to different soles of shoes, and has furthermore disadvantages, for example, the lateral sole mountings and the sole down-holding means cannot be constructed in one piece.

The orderly functioning of a front jaw of a ski binding depends very much on its correct adjustment. Particularly critical is the adjustment of the height of the sole holders which in most cases is carried out by a service technician. This adjustment is very time-consuming, since it must be extremely exact in order not to influence the release behavior of the front jaw.

SUMMARY OF THE INVENTION

One purpose of the invention is, on the one hand, to simplify the assembly of a front jaw for a ski binding and, on the other hand, to limit in upward direction the automatic elevational adjustment of the sole holders, which adjustment is made possible by the swivelling capability of the two housing parts.

Another purpose of the invention is in particular to find an arrangement which is as simple and compact as possible, which arrangement with a simple assembly of the front jaw makes possible at the same time an automatic adjustment of the elevational position of the sole down-holding means to the height of the sole of the shoe and thereby does not influence the behavior of the release spring.

This is done according to the invention by means of a front jaw of the above-identified type, in which the locking means has a locking piece with at least one stop surface, which locking piece is horizontally movable in the lower part of the housing or in the upper part of the housing, and cooperates in the position of use of the ski binding with a stop provided on the upper part of the housing or on the lower part of the housing, thus limiting in this position the swivelling movement of the upper part of the housing relative to the lower part of the housing.

The horizontally movable locking piece offers the advantage of delivering the front jaw in a preadjusted position of use form which is already ready for use, with the serviceman being able to very quickly and still precisely carry out possibly needed adjustments with respect to the swivelling capability of the upper part of the housing by means of this locking piece. Furthermore, this solution offers additional advantages during a rearward or diagonal release of the front jaw.

The solution of the invention can be realized with respect to the locking piece through various embodiments. The locking piece has in the simplest case one single horizontal stop surface, whereas other embodiments have at least two different stop surfaces, of which selectively one is used to define the swivelling movement of the upper part relative to the lower part of the housing. This measure additionally increases the stability of the ski shoe in the front jaw.

One particularly advantageous embodiment of a front jaw of the invention is the one in which a spring is provided in the upper and/or lower part of the housing, which spring biases the swivelling movement of the upper part of the housing relative to the lower part of the housing in direction of the position of use. This spring force can be either the release spring itself, which acts through a spring lever on the lower part of the housing, or a separate spring, in particular a leaf spring, can be provided for this purpose, which acts between the upper part and the lower part of the housing. The height of the sole holders is with this spring force automatically and steplessly adjusted to the height of the sole of the ski shoe when the user steps with his ski shoe into the binding.

Usually several factors must be considered in the new development of ski bindings. Up to now such factors were, for example, the operating safety and related new technical characteristics or a simple and inexpensive manufacture while maintaining the necessary technical operating characteristics. However, a further factor has been added over the last several years, namely a quick and exact adjustability of the binding, with mainly the rental business requesting mostly that the ski binding be able to be adjusted with few manipulations or even automatically to different ski shoes or rather users. The invention, which will be discussed hereinafter in connection with different embodiments, relates to a front jaw with an automatic elevational adjustment of the sole holders, with this front jaw being able to be manufactured inexpensively and being able to be easily assembled. These The foregoing embodiments are illustrated in the accompanying FIGS. 1 to 12b, which show:

DETAILED DESCRIPTION

Figure 1:
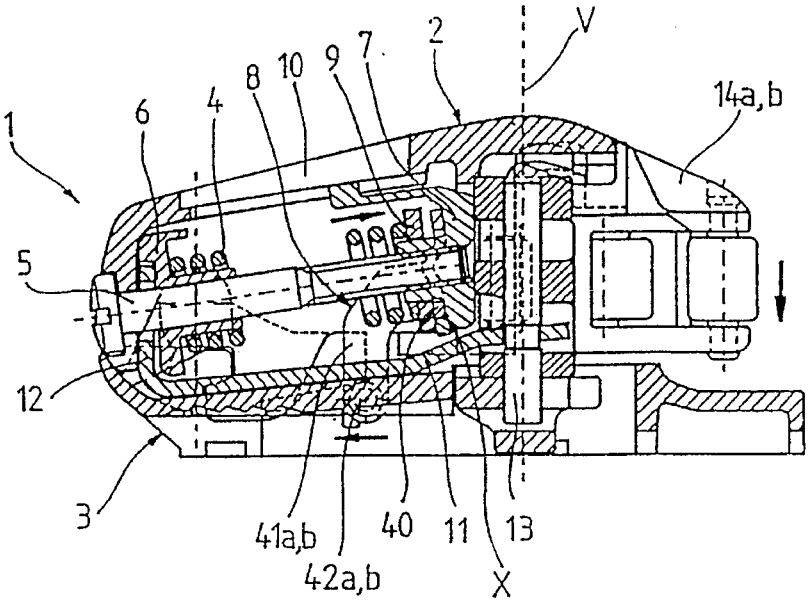
FIG. 1 is a cross-sectional view of a front jaw of the invention in its position of use.
Figure 2:
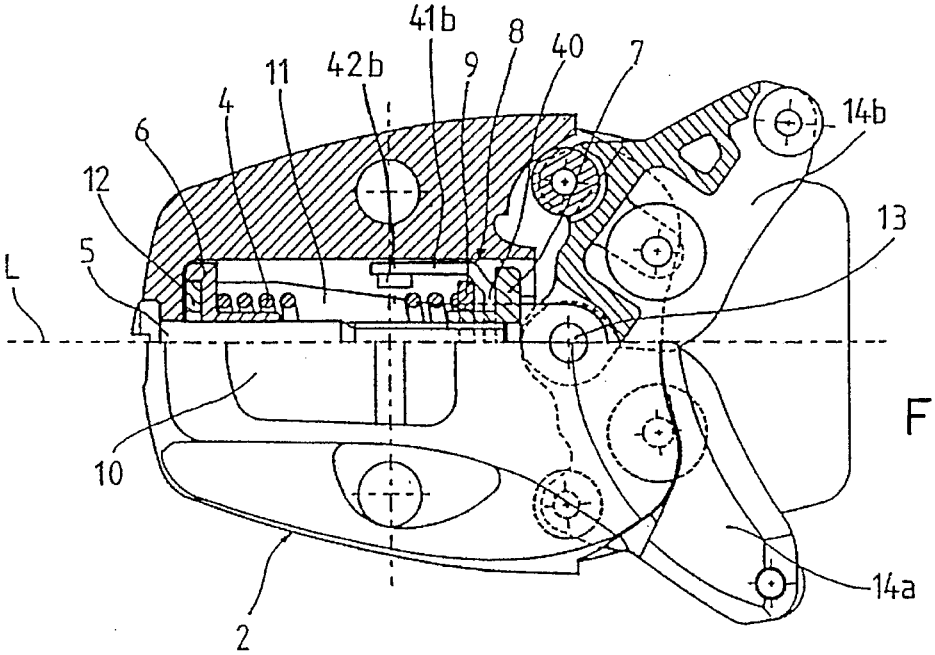
FIG. 2 is a partially cross-sectioned top view of the front jaw according to FIG. 1.

First, reference is made to FIGS. 1 and 2, which illustrate a front jaw 1 which consists of an upper part 2 and a lower part 3 of a housing. A release spring 4 is supported in the upper part 2 of the housing between a front spring-support plate 6 and a rear spring-support plate 7, with the front spring-support plate 6 being supported through the release system on the upper part of the housing and the rear spring-support plate 7 being mechanically connected through an adjusting screw 5 to the front side of the upper part 2 of the housing. The upper part of the rear spring-support plate is designed as a pointer and indicates to the user through a window 10 placed on the upper side of the upper part of the housing the initial tension of the release spring 4, which initial tension is adjusted by the adjusting screw 5. A spring lever 8 and a bearing plate 9 are additionally inserted in the here illustrated exemplary embodiment between the release spring 4 and the rear spring-support plate 7, with the angular spring lever 8 being supported on the rear spring-support plate 7 and acting through the bearing plate 9 on the release spring. The inventive operation of this spring lever 8 will be discussed in greater detail later on. An angled section 12 of a pull piece 11 is furthermore inserted between the front spring-support plate 6 and the front side of the upper part 2 of the housing. A vertically oriented bolt 13 engages the other end of the elongated pull piece 11, on which bolt are supported the sole holders 14*a*, 14*b* of the front jaw. The sole holders 14*a, b* are supported in such a manner on the upper part of the housing that a lateral, rearward and diagonal release of the front jaw is possible. The operation of these sole holders, however, is not a part of this invention and will therefore here not be discussed in detail.

Figure 3:
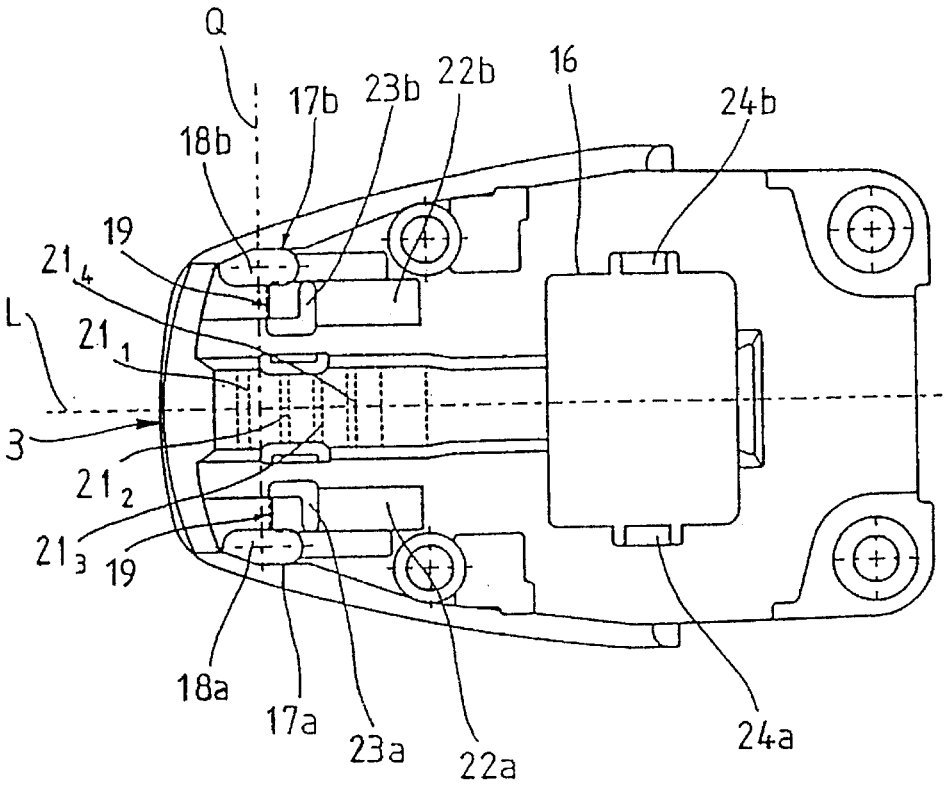
FIG. 3 is a top view of the lower part of the housing of a front jaw of the invention.
Figure 4:
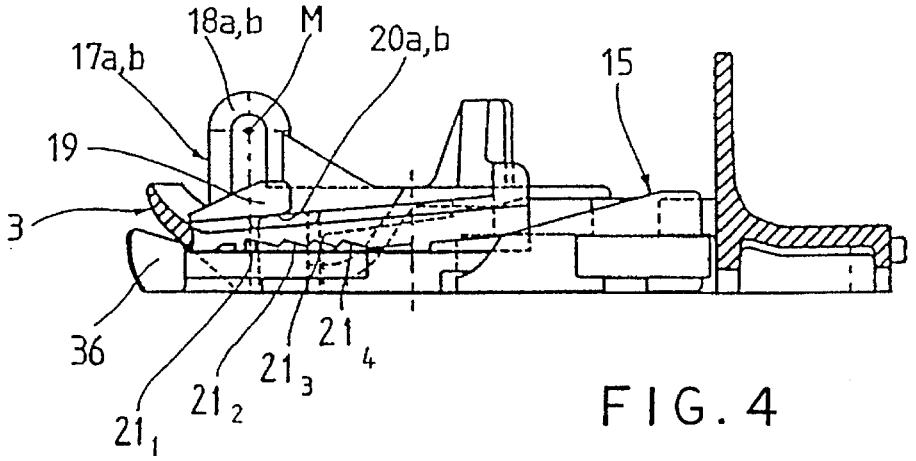
FIGS. 4 and 5 are a central longitudinal cross-sectional view and a bottom view illustration of the lower part of the housing according to FIG. 3.
Figure 5:
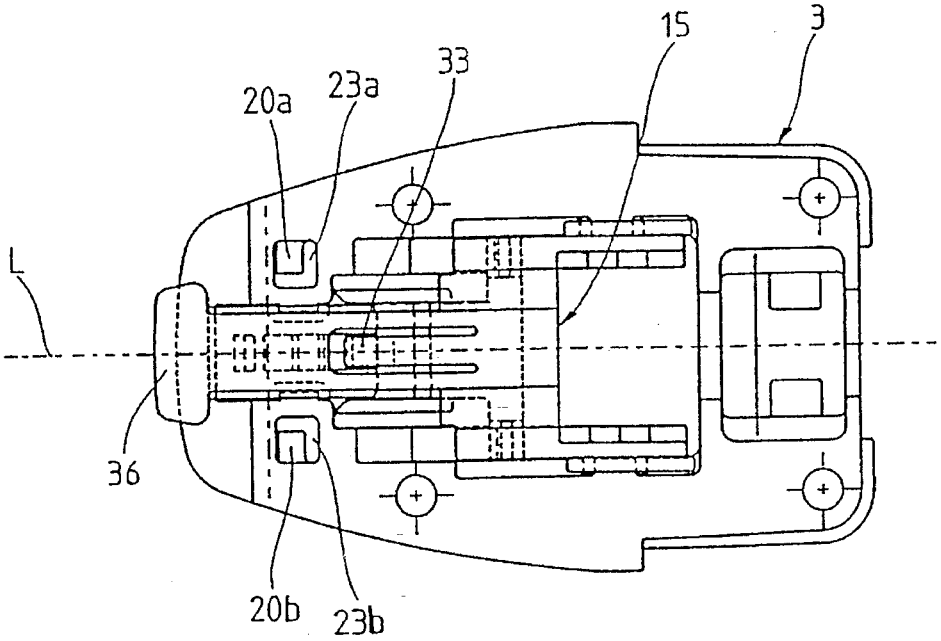
Figure 8:
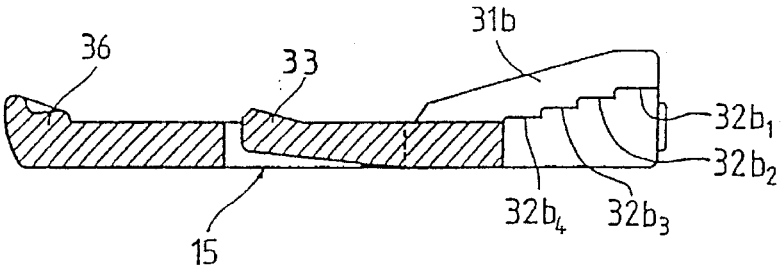
FIGS. 7 and 8 are, respectively, a top view and a longitudinal cross-sectional view of a locking piece of the front jaw of the invention.
Figure 7:
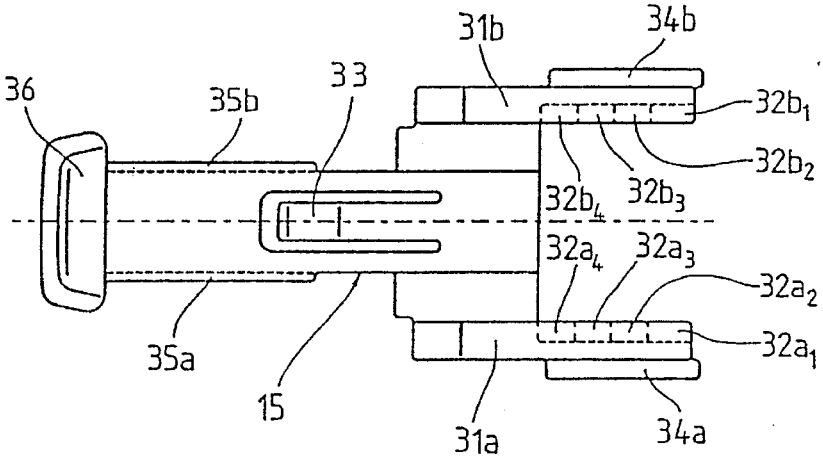

The lower part 3 of the housing is shown in various views in FIGS. 3 to 5, with FIGS. 4 and 5 showing in addition a locking piece 15 separately illustrated in FIGS. 7 and 8. The top view of the lower part 3 of the housing illustrated in FIG. 3 shows a central recess 16 for this locking piece 15. Two flat bearing parts 17*a*, 17*b* lying on a transverse axis Q and are oriented symmetrically with respect to the central longitudinal axis L in the area of the sides of the housing at the front part of the lower part of the housing, which bearing parts terminate at their upper ends into rounded bearing heads 18*a*, 18*b* (see FIG. 4). An engaging element 19 in the form of two projections 20*a*, 20*b* is formed on the inside of these bearing parts 17*a*, 17*b* in the lower part of the housing. Several V-shaped locking elements $\mathbf{21}_1$, $\mathbf{21}_2$, $\mathbf{21}_3$, $\mathbf{21}_4$ are provided one after the other on the underside of the lower part of the housing between these projections 20*a, b*, which locking elements are aligned transversely with respect to the central longitudinal axis. Elongated recesses 22*a*, 22*b* are additionally provided in the lower part 3 of the housing in a direction longitudinally behind the projections 20*a, b*, which recesses terminate in the direct vicinity of the projections 20*a, b* in openings 23*a*, 23*b*. Two hooks 28*a*, 28*b* on the upper part 2 of the housing, which hooks are in engagement with the projections 20*a, b*, are received, in the position of use of the front jaw, in these elongated recesses 22*a, b*. Guide elements 24*a, b* are furthermore provided on the lower part of the housing at the lateral edge of the recess 16 for the locking piece 15, on which guide elements the locking piece 15 is movably supported in longitudinal direction. FIGS. 4 and 5 show the locking piece 15 already in the installed state. Detailed characteristics of the locking piece 15 will be discussed in detail hereinafter with reference to FIGS. 7 to 10.

Figure 6:
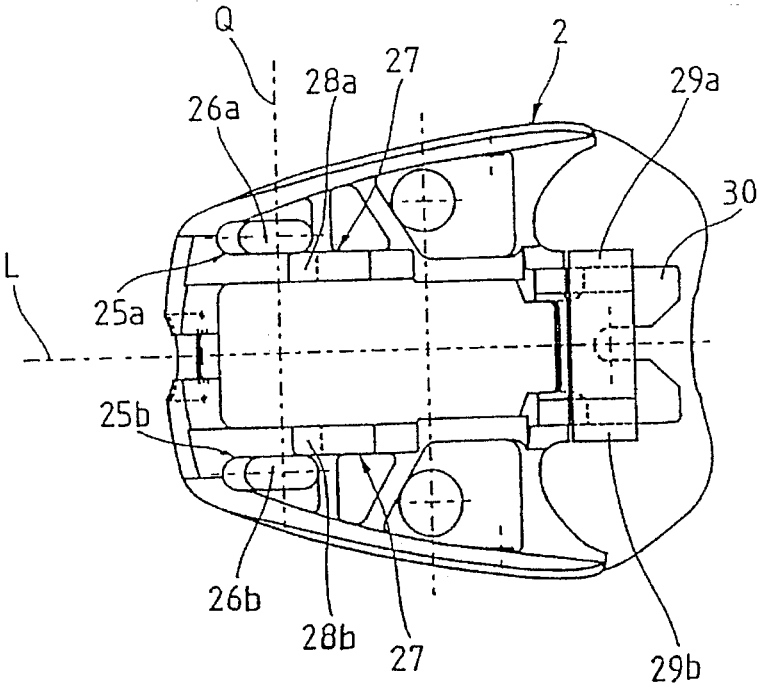
FIG. 6 is a bottom view illustration of the upper part of the housing of a front jaw of the invention.

FIG. 6 shows a bottom view of the upper part 2 of the housing of a front jaw 1 of the invention, which is here shown without the release spring 4 and the sole holders 14*a, b* and other parts. Two conically tapering bearing points 25*a*, 25*b* are arranged in the area of the sides of the housing on the transverse axis Q and symmetrically with respect to the central longitudinal axis L in the front part of the upper part 2 of the housing, which bearing points terminate at their upper ends into rounded bearing surfaces 26*a*, 26*b*. These bearing points 25*a, b* are in the position of use of the front jaw associated with the bearing parts 17*a, b* and form together with these a joint, by means of which the upper part 2 of the housing is pivotally and removably supported on the lower part 3 of the housing. The axis of rotation of this joint extends along the transverse axis Q and goes through the respective centerpoints M of the bearing heads 18*a, b* and the bearing surfaces 26*a, b*. A hook element 27 in the form of two hooks 28*a*, 28*b* is provided on the upper part of the housing in the direct vicinity of the bearing points 25*a, b*. These hooks 28*a, b* engage in the position of use of the front jaw the projections 20*a, b* of the engaging element 19 and prevent in this position of use a lifting of the bearing surfaces 26*a, b* from the bearing heads 18*a, b*, thus completely creating the joint between the upper part of the housing and the lower part of the housing. A central guide plate 30 is constructed in the rear part of the upper part 2 of the housing, along which guide plate is guided the bolt 13 provided with the sole holders 14*a, b*. The guide surface of this guide plate 30 is tapered, diverging in a rearward direction and thus permits in addition to the lateral and rearward release also a diagonal release of the front jaw, in particular during backward twisting falls. A stop block with two lateral stops 29*a*, 29*b* is provided in the upper part 2 of the housing below the guide plate 30. Each one of these stops 29*a, b* cooperates in the position of use of the front jaw 1 with a selected stop surface $32a_1$, $32b_1$, $_{32}a_2$, $32b_2$, $32a_3$, $32b_3$, $32a_4$, $32b_4$ on the locking piece 15.

Figure 10:
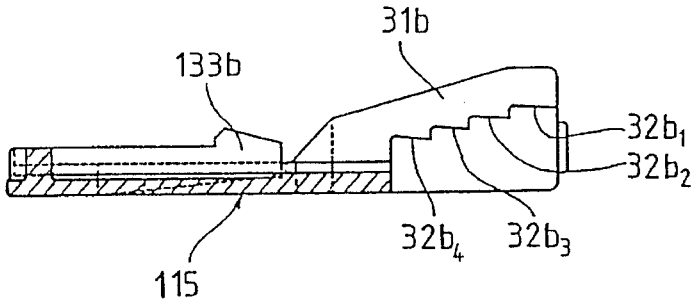
FIGS. 9 and 10 are, respectively, a top view and a longitudinal cross-sectional view of a further embodiment of a locking piece.
Figure 9:
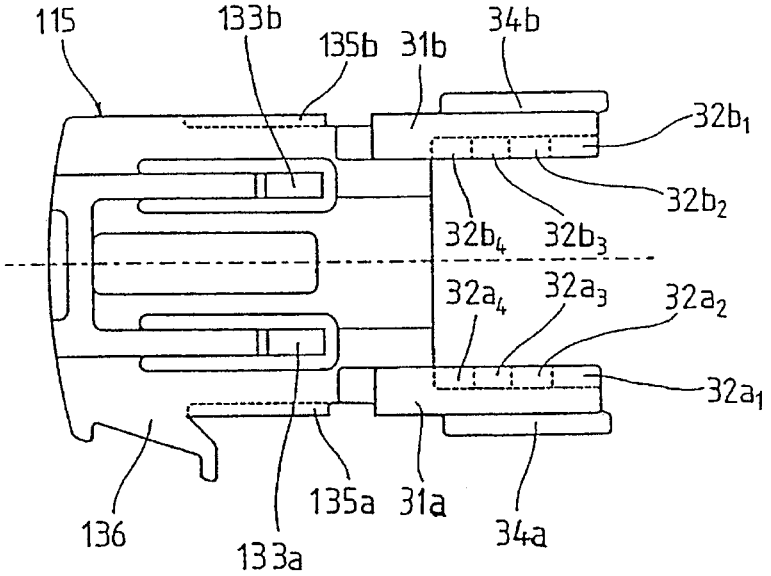

FIGS. 7 and 8 and also FIGS. 9 and 10 show two different embodiments of a locking piece 15 or 115. Both locking pieces have a fork-shaped design and have two fork arms 31*a*, 31*b*. Viewed from above, stop surfaces $32a_1$, $32b_1$, $32a_2$, $32b_2$, $32a_3$, $32b_3$, $32a_4$, $32b_4$ are arranged one after the other on the underside of each fork arm 31*a, b*. Respective ones of these stop surfaces $32a_1$, $32b_1$, $32a_2$, $32b_2$, $32a_3$, $32b_3$, $32a_4$, $32b_4$ cooperate in the position of use of the front jaw with selected ones stop 29*a, b*. Due to the differing elevational position of the stop surfaces lying one after the other, the swivelling capability of the upper part 2 of the housing relative to the lower part 3 of the housing is limited to a predetermined degree. The adjustment is done by a horizontal movement of the locking piece 15 or rather 115. Furthermore, these locking pieces 15, 115 have force-transfer elements 34*a*, 34*b* formed on each fork arm 31*a, b*, which elements cooperate in the position of use of the front jaw with the guideways 24*a, b*. One upwardly projecting locking nose 33 is provided in the center part of the locking piece 15, whereas in the case of the locking piece 115 two locking noses 133*a*, 133*b* lying symmetrically with respect to the central longitudinal axis are provided. These locking noses engage in the position of use of the front jaw one of the V-shaped recesses $21_1$, $21_2$, $21_3$, $21_4$. Thus, an inadvertent movement of the locking piece in horizontal direction is prevented. The locking piece 15 or 115 has furthermore lateral sliding guides 35*a*, 35*b* or 135*a*, 135*b* and a handle 36 or 136, by means of which the horizontal adjustment of the locking piece can be carried out by a service technician. The locking piece 15 or 115 can in an embodiment not shown here also have one single horizontal stop surface, a handle on the locking piece is then not needed since only one single horizontal adjustment makes sense and same is already preadjusted during assembly of the front jaw.

Figure 11:
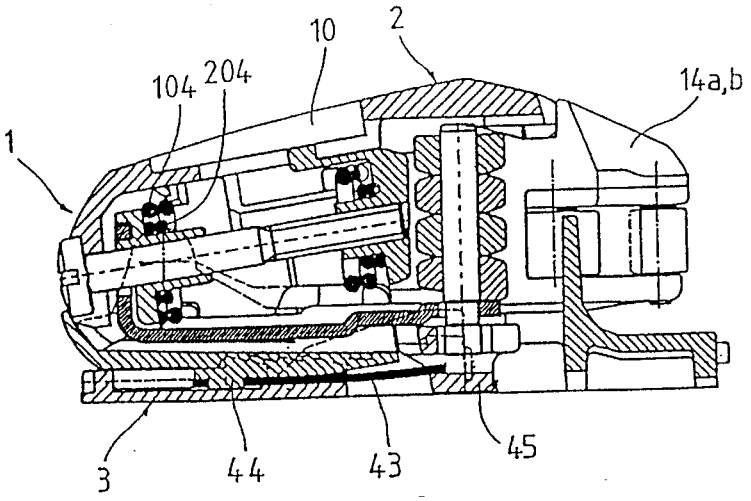
FIG. 11 is a cross-sectional view of a further embodiment of a front jaw of the invention in its position of use.

A spring force acts both in the exemplary embodiment illustrated in FIG. 1 and also in the front jaw illustrated in FIG. 11 between the upper part 2 of the housing and the lower part 3 of the housing, which spring force in connection with the joint and the locking piece enables a stepless elevational adjustment of the sole holders 14*a, b* to the height of the sole of the ski shoe. The spring force is in the exemplary embodiment illustrated in FIG. 1 made available by the release spring 4, with the spring action needed for the automatic elevational adjustment of the sole holder being transferred onto the lower part 3 of the housing through a spring lever 8. The spring lever 8 is designed with two arms and is fork-shaped viewed from above. The first lever arm of the spring lever 8 is a bearing piece 40, with which the spring lever is supported on the rear spring-support plate 7 and acts on the release spring 4 through the bearing plate 9. The second lever arm is formed by two angular arms 41*a*, 41*b*, which are designed in one piece with the bearing piece 40. These arms extend, viewed from above, laterally past the release spring to the lower part 3 of the housing. The arms 41*a, b* act in the position of use through two projections 42*a*, 42*b* constructed at their ends and project laterally inwardly of the lower part 3 of the housing or of the locking piece 15 movably supported in the lower part of the housing. The operation of this spring lever can be easily seen in FIG. 1. The fulcrum point of the spring lever 8 lies in the point identified by the letter X, which lies in the lower area of the bearing piece 40. Above the adjusting screw 5, in the area of the bearing piece 40, the bearing piece is urged in direction of the arrow direction through the bearing plate 9 by the release spring 4. Thus, a moment is created on the second lever arms 41*a, b*, which moment produces a force in the forward direction of the arrow on the projections 42*a*, 42*b* of these arms, thus causing the upper part 2 of the housing to be urged in a direction toward the lower part 3 of the housing and the sole holders 14*a, b* are thus pressed in direction of the downwardly arrow. The structural arrangement shown in FIG. 1 shows clearly that the elevational adjustment of the sole holders does not influence or only insignificantly influences the release spring 4 and thus the release behavior of the front jaw. The adjustment of the release spring and the indication of the same remains also untouched.

A leaf spring 43 is provided for producing the spring force in the embodiment of the front jaw illustrated in FIG. 11, which leaf spring is supported in a guideway 44 of the lower part 3 of the housing and acts on a further stop 45 of the upper part of the housing. The elevational adjustment of the sole holders acts in this case completely independent of the release spring, which in this exemplary embodiment is realized in the form of two springs 104, 204.

Figure 12A:
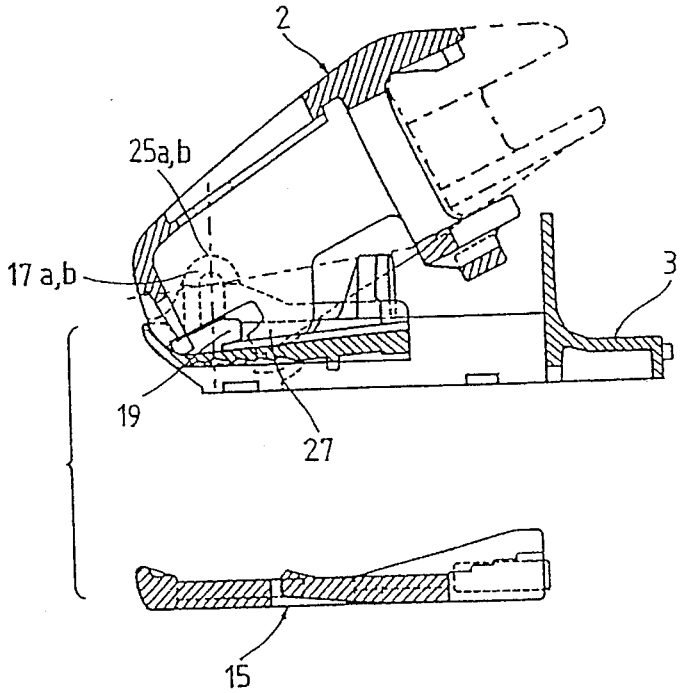
FIGS. 12*a* and 12*b* are illustrations of the assembly of a front jaw of the invention.
Figure 12B:
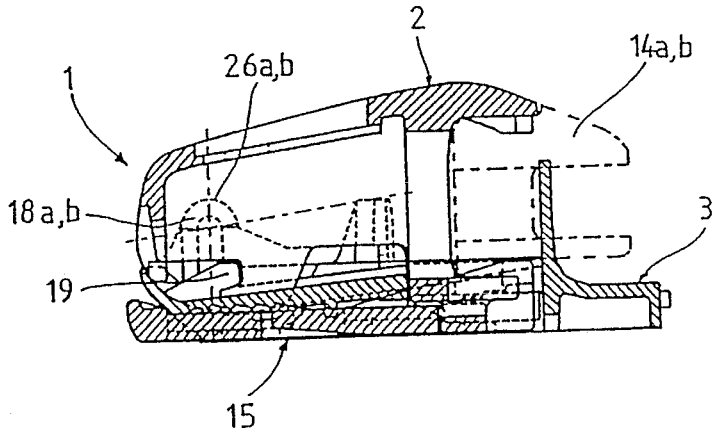

In conclusion, the assembly of a front jaw of the invention illustrated in FIG. 12 is here discussed in greater detail. After the upper part 2 of the housing has been completely assembled, namely has been provided with the release spring 4, the sole holders 14*a, b*, etc., this upper part 2 of the housing, as can be seen in FIG. 12, is placed onto the lower part of the housing at an angle of approximately 30° so that the bearing surfaces 25*a, b* rest on the bearing heads 18*a, b*. The upper part 2 of the housing can then be pivoted in direction of the lower part of the housing, with the hooks 28*a, b* of the hook elements 27, as can be seen in FIG. 12*b*, being received under the projections 20*a, b* of the engaging element 19 and thus creating a complete joint connection between the upper part and the lower part of the housing. The locking piece 15 is finally inserted from below into the recess 16 of the lower part of the housing and is moved horizontally rearwardly until the locking nose 33 engages the first one $21_1$, of the V-shaped recesses $21_1$, $21_2$, $21_3$, $21_4$. The stop surface $32a_1$, $b_1$, which is the highest one, cooperates in this position with the stop 29*a, b* of the upper part of the housing. A maximum angle of horizontal swing of the upper part of the housing and thus a maximum elevational adjustment of the sole holders is preadjusted in this manner during the assembly of the front jaw. In the embodiment with the spring lever 8 illustrated in FIG. 1, the spring lever acts with its lateral projections 42*a*, 42*b* on the sliding guide 35 of the locking piece 15, thus creating at the same time with the installation of this locking piece the resilient connection between the upper part and the lower part of the housing. In the embodiment of the leaf spring 43 illustrated in FIG. 11, the spring is also installed at the same time with the locking piece 15 and is held during the horizontal movement of this locking piece in the guideway 44 on the lower part of the housing so that it acts on the stop 45 of the upper part of the housing.

The front jaw of the ski binding is now in this state fastened on the ski. This is done by the lower part 3 of the housing being fastened on the ski preferably by means of screws such that the upper part of the housing remains pivotal against spring force in the specified area. No further adjusting of the front jaw with respect to the sole holders is needed in an embodiment of the front jaw, which is not shown here, however, is preferably utilized in the rental business, and in which the locking piece has one single stop surface. In the front jaw with the locking pieces according to FIGS. 7 to 10, the ski shoe is inserted into the mounted ski binding, with the sole holders or rather the upper part of the housing moving upwardly against the spring force corresponding with the height of the sole of the shoe. The locking piece 15, 115 is now, with the ski shoe inserted, moved horizontally as far as possible rearwardly in direction of the ski shoe so that a suitable one of the stop surfaces $32a_1$, $32b_1$, $32a_2$, $32b_2$, $32a_3$, $32b_3$, $32a_4$, $32b_4$ is directly above the stop 29. This stop surface is the one which, in the position of the sole holders specified by the ski shoe, lies just yet above the stop 29, with the position of the locking piece 15, 115 being one in which the locking nose 33, 133 of this locking piece engaging one of the V-shaped recesses $21_1$, $21_2$, $21_3$, $21_4$. This reduces the range of swivelling of the upper part 2 of the housing relative to the lower part 3 of the housing to a degree which is actually needed for the sole of this ski shoe. This significantly increases the stability of the ski shoe in the front jaw. The advantage of this additional limitation can also be noticed in the rearward release behavior of the ski binding. When the sole holders are urged upwardly during a backward or a backward twisting fall, the upper part of the housing is first pivoted upwardly until the stop 29*a, b* rests on the respective stop surface $32a_1$, $32b_1$, $32a_2$, $32b_2$, $32a_3$, $32b_3$, $32a_4$, $32b_4$ of the locking piece 15, 115. Only after this is the actual rearward release mechanism started, the bearing bolt 13 for the sole holders 14*a, b* is pivoted out of its vertically oriented position so that its lower end is moved rearwardly along the guide surface recessed in the guide block 30 and thus acts through the pull piece 11 on the release spring 4. The force acting upwardly on the sole holders 14*a, b* must be sufficiently large for a rearward release in order to swivel the sole holders until the ski shoe slides upwardly out of the front jaw. The tapered enlargement of the guide surface for the bearing bolt facilitates, in particular during backward twisting falls by swivelling the bearing bolt 13 out of its central position, an upwardly inclined diagonal release of the front jaw causing the ski shoe to be released.

We claim:

1. A front jaw for a safety binding having a housing with upper and lower parts, the lower part of the housing being adapted to be fastened to an upper surface of a ski, the upper part of the housing having at least one adjustable release spring and two pivotal sole holders, the pivotal sole holders each being loaded by the release spring, bearing means for supporting the upper and lower parts for relative pivotal movement so that the upper part of the housing, in a position of use of the front jaw, is pivotal about a transverse axis which extends normally with respect to a central longitudinal axis of the front jaw, the pivotal capability of the upper part of the housing relative to the lower part of the housing being limited by a locking means, said locking means includes a locking piece on one of the upper and lower housing parts and at least one stop on the other of the upper and lower housing parts, the locking piece having a plurality of stop surfaces extending in differing elevational positions thereon, and wherein guide means are provided for guiding the locking piece for horizontal movement to orient a selected stop surface relative to the stop which, in the position of use of the ski binding, causes the stop to operatively cooperate with the selected one of the plurality of stop surfaces to establish a limit for the relative pivotal movement between the upper and lower parts of the housing while simultaneously facilitating the establishment of an elevational adjustment of the sole holders relative to the upper surface of the ski to accommodate differing thicknesses of soles on ski shoes.

2. The front jaw according to claim 1, wherein the at least one adjustable release spring is provided in the upper part of the housing, the spring effecting a continuous yieldable urging together of the upper and lower parts of the housing and yielding to allow an operative engagement of the stop with the selected one of the stop surfaces upon a tendency to separate the upper and lower parts.

3. The front jaw according to claim 2, wherein a spring force provided by the adjustable release spring is transmitted through a spring lever onto the lower part of the housing, the spring lever being supported in the upper part of the housing and engages with a two arm bearing piece, a first arm of the two arm bearing piece engaging the release spring and a second arm thereof engaging the backing piece.

4. The front jaw according to claim 3, wherein the spring lever is constructed fork-shaped viewed from above, a center part of the spring lever constituting the first arm acting on the release spring, and each second arm is integral with the center part of the spring lever, each of the second arms operatively engaging the lower part of the housing and straddling the release spring, each of the second arms having lateral projections, which operatively engage the locking piece.

5. The front jaw according to claim 2, wherein a spring force, separate from a further spring force provided by the adjustable release spring, is transmitted through a leaf spring supported in the lower part of the housing and engages the upper part of the housing.

6. The front jaw according to claim 1, wherein the locking piece, viewed from above, is fork-shaped so as to define two fork arms and is symmetrical with respect to the central longitudinal axis, and wherein the stop surfaces are arranged on the underside of the two fork arms.

7. The front jaw according to claim 1, wherein the locking piece has lateral force-transfer elements operatively engaging sliding guides on the lower part of the housing.

8. The front jaw according to claim 1, wherein the locking piece has at least one elastic locking nose operatively engaging with locking elements provided on the upper part of the housing, the number of the locking elements being equal to the number of the stop surfaces on the locking piece.

9. The front jaw according to claim 1, wherein the locking piece has a handle.

10. The front jaw according to claim 1, wherein the bearing means includes bearing parts on the lower part of the housing and extending vertically upwardly therefrom and having bearing heads at upper distal ends thereof, and at least one engaging element, and bearing points on the upper part of the housing operatively engaging the bearing parts, the bearing parts having bearing surfaces and at least one hook element operatively engaging the engaging element, the upper part of the housing being removably supported on the lower part of the housing in an open position of the front jaw, and, starting out from the open position, being pivotally supported about the transverse axis which extends in the region of the bearing heads.

11. The front jaw according to claim 10, wherein the bearing parts are arranged in a front part of the lower part of the housing symmetrically on both sides of the central longitudinal center axis and are aligned parallel with respect to the central longitudinal axis.

12. The front jaw according to claim 10, wherein the bearing heads of the bearing parts are rounded semicircularly and the associated bearing surfaces of the bearing points are also constructed rounded, the transverse axis about which the upper part of the housing is pivotal relative to the lower part of the housing extending through a centerpoint of one of the bearing heads and the bearing surfaces.

13. The front jaw according to claim 10, wherein at least one hook element in the form of two horizontal projections formed in the direct vicinity of the bearing parts is formed on the lower part of the housing, the projections being arranged on the side of the bearing parts at least one of toward and away from the central longitudinal axis of the front jaw, and wherein the at least one hook element is in the form of two hooks formed in the direct vicinity of the bearing points on the upper part of the housing, the hooks, in the position of use, engaging the projections on the lower part of the housing and being able to be disengaged in the open position of the front jaw.

14. The front jaw according to claim 3, wherein the spring lever is constructed fork-shaped viewed from above, a center part of the spring lever constituting the first arm acting on the release spring, and each second arm is integral with the center part of the spring lever, each of the second arms operatively engaging the lower part of the housing and straddling the release spring, each of the second arms having lateral projections, which operatively engage a sliding guide on the locking piece supported on the lower part of the housing.

* * * * *

UNITED STATES PATENT AND TRADEMARK OFFICE

CERTIFICATE OF CORRECTION

PATENT NO. : 5,529,331

DATED : June 25, 1996

INVENTOR(S) : Klaus HOELZL et al.

It is certified that error appears in the above-indentified patent and that said Letters Patent is hereby corrected as shown below:

Column 8, line 36; change "backing" to ---locking---.

Signed and Sealed this

Twenty-sixth Day of November 1996

*Attest:*

Bruce Lehman

BRUCE LEHMAN

*Attesting Officer*

*Commissioner of Patents and Trademarks*